US011018426B2

(12) United States Patent
Chuang et al.

(10) Patent No.: US 11,018,426 B2
(45) Date of Patent: May 25, 2021

(54) ANTENNA STRUCTURE

(71) Applicant: Wistron Corp., New Taipei (TW)

(72) Inventors: Nien-Chao Chuang, New Taipei (TW); Pei-Cheng Hu, New Taipei (TW); Feng-Yi Lin, New Taipei (TW)

(73) Assignee: WISTRON CORP., New Taipei (TW)

( * ) Notice: Subject to any disclaimer, the term of this patent is extended or adjusted under 35 U.S.C. 154(b) by 56 days.

(21) Appl. No.: 16/380,117

(22) Filed: Apr. 10, 2019

(65) Prior Publication Data

US 2020/0259260 A1 Aug. 13, 2020

(30) Foreign Application Priority Data

Feb. 13, 2019 (TW) ..... 108104687

(51) Int. Cl.

| | |
|---|---|
| ***H01Q 5/30*** | (2015.01) |
| ***H01Q 1/36*** | (2006.01) |
| ***H01Q 9/04*** | (2006.01) |
| ***H01Q 1/24*** | (2006.01) |

(52) U.S. Cl.

CPC ..... *H01Q 5/30* (2015.01); *H01Q 1/241* (2013.01); *H01Q 1/36* (2013.01); *H01Q 9/04* (2013.01)

(58) Field of Classification Search

CPC .. H01Q 5/30; H01Q 5/40; H01Q 1/24; H01Q 1/241; H01Q 1/243; H01Q 1/36; H01Q 9/00; H01Q 9/04; H01Q 9/12

See application file for complete search history.

(56) References Cited

U.S. PATENT DOCUMENTS

| | | | | |
|---|---|---|---|---|
| 6,243,592 | B1 * | 6/2001 | Nakada | H01Q 1/243 455/575.7 |
| 6,717,551 | B1 * | 4/2004 | Desclos | H01Q 1/241 343/700 MS |
| 9,673,510 | B2 | 6/2017 | Lin | |
| 10,411,333 | B1 * | 9/2019 | Chang | H01Q 1/36 |
| 10,522,902 | B1 * | 12/2019 | Tseng | H01Q 9/42 |
| 2008/0001832 | A1 * | 1/2008 | Murakami | H01Q 1/243 343/702 |
| 2009/0153415 | A1 * | 6/2009 | Hsieh | H01Q 1/2258 343/702 |

(Continued)

FOREIGN PATENT DOCUMENTS

| | | |
|---|---|---|
| EP | 2 622 683 A1 | 8/2013 |
| TW | I237923 A | 8/2005 |
| WO | 2012/047722 A1 | 4/2012 |

OTHER PUBLICATIONS

Chinese language office action dated Dec. 30, 2019, issued in application No. TW 108104687.

(Continued)

*Primary Examiner* — Thai Pham

(74) *Attorney, Agent, or Firm* — McClure, Qualey & Rodack, LLP

(57) ABSTRACT

An antenna structure includes a first radiation element, a second radiation element, and a third radiation element. The first radiation element has a feeding point. The third radiation element is coupled through the second radiation element to the first radiation element. The third radiation element has a first opening and a second opening which are separate from each other. The antenna structure covers a first frequency band, a second frequency band, and a third frequency band.

19 Claims, 3 Drawing Sheets

(56) References Cited

U.S. PATENT DOCUMENTS

| | | | | |
|---|---|---|---|---|
| 2011/0199265 | A1* | 8/2011 | Lin | H01Q 5/378<br>343/700 MS |
| 2012/0076184 | A1* | 3/2012 | Tran | H01Q 1/48<br>375/222 |
| 2018/0048076 | A1* | 2/2018 | Wei | H01Q 9/045 |
| 2019/0198975 | A1* | 6/2019 | Chen | H01Q 1/48 |

OTHER PUBLICATIONS

Indian language office action action dated Dec. 17, 2020, issued in application No. IN 201924016721.

* cited by examiner

ANTENNA STRUCTURE

CROSS REFERENCE TO RELATED APPLICATIONS

This Application claims priority of Taiwan Patent Application No. 108104687 filed on Feb. 13, 2019, the entirety of which is incorporated by reference herein.

BACKGROUND OF THE INVENTION

Field of the Invention

The disclosure generally relates to an antenna structure, and more particularly, to a wideband antenna structure.

Description of the Related Art

With advancements in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi, Bluetooth and WiMAX (Worldwide Interoperability for Microwave Access) systems and using frequency bands of 2.4 GHz, 3.5 GHz, 5.2 GHz, and 5.8 GHz.

Antennas are indispensable elements for wireless communication. If an antenna for signal reception and transmission has insufficient bandwidth, it will tend to degrade the communication quality of the relative mobile device. Accordingly, it has become a critical challenge for antenna designers to design a wideband antenna element that is small in size.

BRIEF SUMMARY OF THE INVENTION

In an exemplary embodiment, the invention is directed to an antenna structure that includes a first radiation element, a second radiation element, and a third radiation element. The first radiation element has a feeding point. The third radiation element is coupled through the second radiation element to the first radiation element. The third radiation element has a first opening and a second opening which are separate from each other. The antenna structure covers a first frequency band, a second frequency band, and a third frequency band.

In some embodiments, the first frequency band is substantially 1575 MHz, the second frequency band is from 2400 MHz to 2500 MHz, and the third frequency band is from 5150 MHz to 5850 MHz.

In some embodiments, the first radiation element substantially has a rectangular shape.

In some embodiments, the second radiation element substantially has a trapezoidal shape.

In some embodiments, the third radiation element substantially has a straight-line shape.

In some embodiments, the first radiation element and the third radiation element are substantially parallel to each other.

In some embodiments, a first angle is formed between the first radiation element and the second radiation element, and the first angle is from 0 to 90 degrees.

In some embodiments, the first angle is substantially equal to 45 degrees.

In some embodiments, a second angle is formed between the third radiation element and the second radiation element, and the second angle is from 0 to 90 degrees.

In some embodiments, the second angle is substantially equal to 45 degrees.

In some embodiments, the sum of the first angle and the second angle is substantially equal to 90 degrees.

In some embodiments, each of the first opening and the second opening substantially has a circular shape.

In some embodiments, the first radiation element, the second radiation element, and the third radiation element are excited to generate the first frequency band.

In some embodiments, the total length of the first radiation element, the second radiation element, and the third radiation element is substantially equal to 0.25 wavelength of the first frequency band.

In some embodiments, the first radiation element and the second radiation element are excited to generate the second frequency band.

In some embodiments, the total length of the first radiation element and the second radiation element is substantially equal to 0.25 wavelength of the second frequency band.

In some embodiments, the first radiation element is excited to generate the third frequency band.

In some embodiments, the length of the first radiation element is substantially equal to 0.25 wavelength of the third frequency band.

In some embodiments, the width of the first radiation element is greater than the width of the third radiation element.

In some embodiments, the width of the third radiation element is greater than the width of the second radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms “include” and “comprise” are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
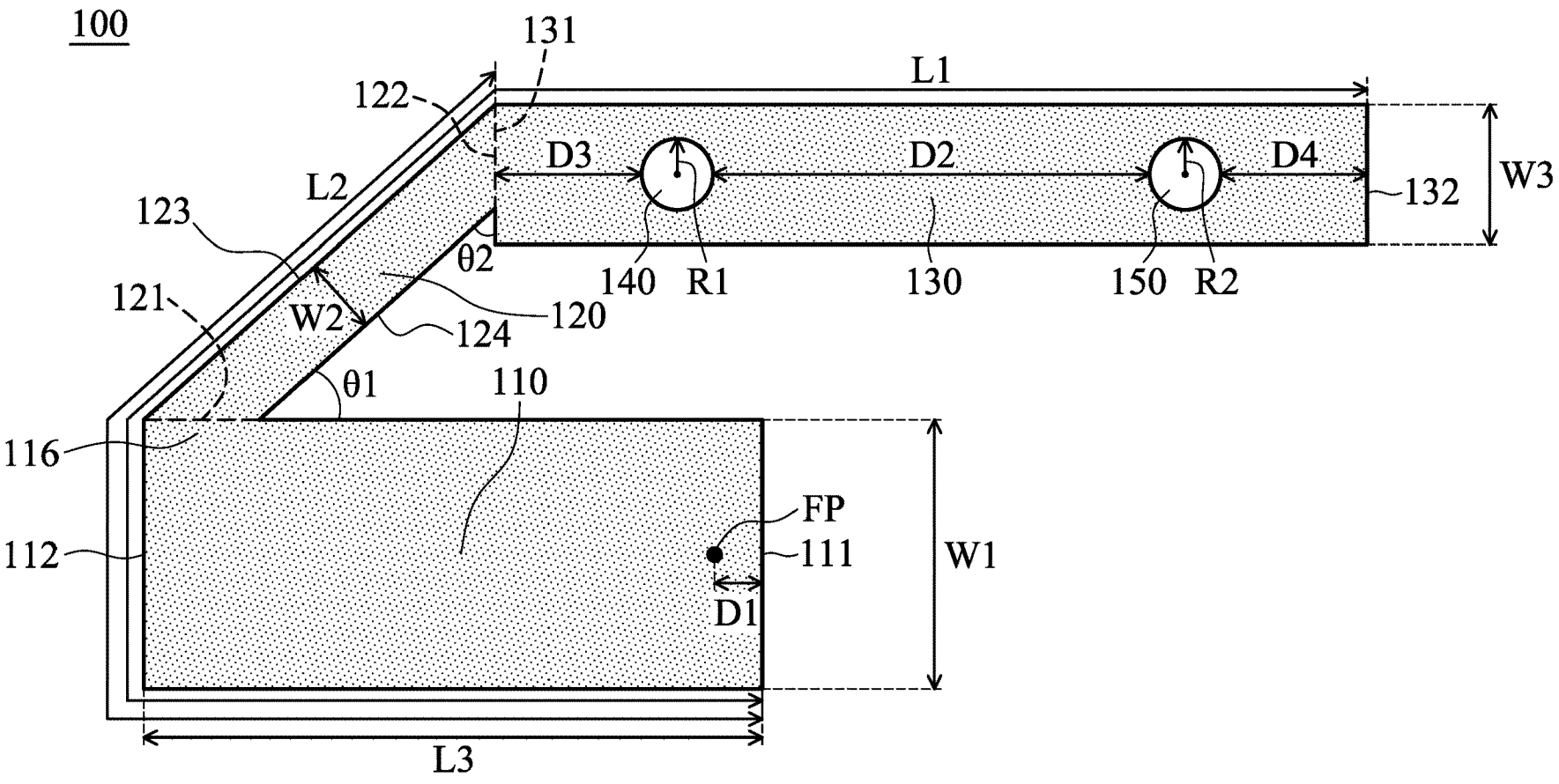
FIG. 1 is a diagram of an antenna structure according to an embodiment of the invention.

FIG. 1 is a diagram of an antenna structure 100 according to an embodiment of the invention. The antenna structure 100 may be applicable to a mobile device, such as a credit card machine, a smart phone, a tablet computer, or a notebook computer. As shown in FIG. 1, the antenna structure 100 includes a first radiation element 110, a second radiation element 120, and a third radiation element 130. The first radiation element 110, the second radiation element 120, and the third radiation element 130 may be made of metal materials, such as copper, silver, aluminum, iron, or their alloys.

The first radiation element 110 may substantially have a rectangular shape. The first radiation element 110 has a first end 111 and a second end 112. A feeding point FP is adjacent to the first end 111 of the first radiation element 110. The feeding point FP may be coupled to a signal source (not shown), such as an RF (Radio Frequency) module for exciting the antenna structure 100. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0).

The second radiation element 120 may substantially has a trapezoidal shape. The second radiation element 120 has a first end 121 and a second end 122. The first end 121 of the second radiation element 120 is coupled to a corner 116 of the first radiation element 110. The second end 122 of the second radiation element 120 is coupled to the third radiation element 130. Thus, the third radiation element 130 is coupled through the second radiation element 120 to the first radiation element 110. Specifically, the second radiation element 120 has a first side 123 and a second side 124 which are opposite to and parallel to each other. The length of the first side 123 is longer than the length of the second side 124. There is a first angle θ1 formed between the first radiation element 110 and the second side 124 of the second radiation element 120. The first angle θ1 may be from 0 to 90 degrees. There is a second angle θ2 formed between the third radiation element 130 and the second side 124 of the second radiation element 120. The second angle θ2 may be from 0 to 90 degrees. In some embodiments, the sum of the first angle θ1 and the second angle θ2 (i.e., θ1+θ2) is substantially equal to 90 degrees.

The third radiation element 130 may substantially have a straight-line shape. The first radiation element 110 and the third radiation element 130 may substantially equal to each other. The third radiation element 130 has a first end 131 and a second end 132. The first end 131 of the third radiation element 130 is coupled to the second end 122 of the second radiation element 120. The second end 132 of the third radiation element 130 is an open end. The second end 132 of the third radiation element 130 and the first end 111 of the first radiation element 110 may substantially extend in the same direction.

The third radiation element 130 has a first opening 140 and a second opening 150 which are separate from each other. For example, each of the first opening 140 and the second opening 150 may substantially have a circular shape, but the invention is not limited thereto. In other embodiments, each of the first opening 140 and the second opening 150 has a square shape, a rectangular shape, or a regular triangular shape (not shown). The first opening 140 and the second opening 150 may be used as two positioning holes of the antenna structure 100. When the antenna structure is applied to a mobile device, two plastic pillars of the mobile device may be inserted into the first opening 140 and the second opening 150, respectively, such that the antenna structure 100 can be fixed. Furthermore, according to the practical measurement, the incorporation of the first opening 140 and the second opening 150 can fine-tune the impedance matching of the antenna structure 100, thereby increasing the whole operation bandwidth of the antenna structure 100.

In some embodiments, the first radiation element 110, the second radiation element 120, and the third radiation element 130 form a planar structure, which may be disposed on a nonconductive supporting element or a dielectric substrate. In alternative embodiments, the first radiation element 110, the second radiation element 120, and the third radiation element 130 form a 3D (Three-Dimensional) structure, so as to fit inside the mobile device.

Figure 2:
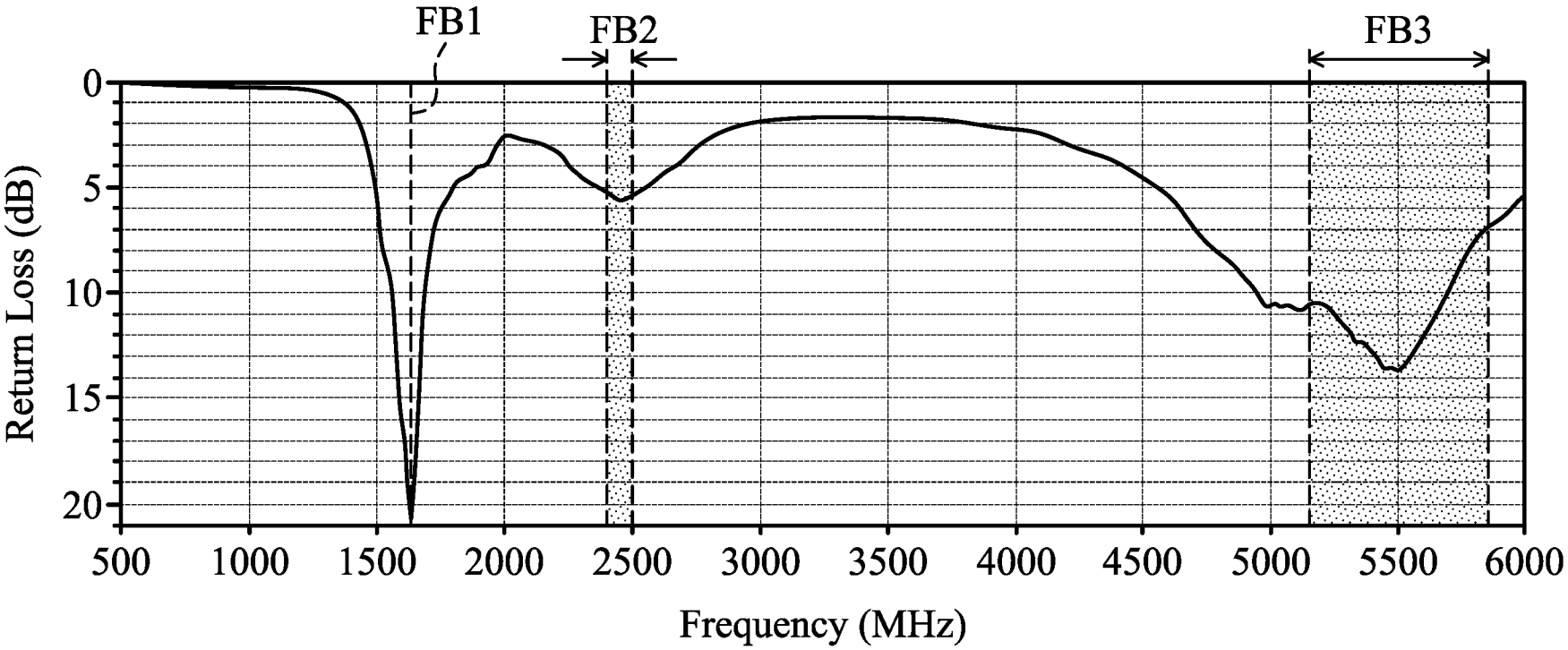
FIG. 2 is a diagram of return loss of an antenna structure according to an embodiment of the invention.

FIG. 2 is a diagram of return loss of the antenna structure 100 according to an embodiment of the invention. The horizontal axis represents the operation frequency (MHz), and the vertical axis represents the return loss (dB). According to the measurement of FIG. 2, the antenna structure 100 can cover a first frequency band FB1, a second frequency band FB2, and a third frequency band FB3. The first frequency band FB1 may be substantially 1575 MHz. The second frequency band FB2 may be from 2400 MHz to 2500 MHz. The third frequency band FB3 may be from 5150 MHz to 5850 MHz. Accordingly, the antenna structure 100 can at least support the multiband and wideband operations of GPS (Global Positioning System) and WLAN (Wireless Local Area Networks) 2.4 GHz/5 GHz.

In some embodiments, the operation principles of the antenna structure 100 are as follows. The first radiation element 110, the second radiation element 120, and the third radiation element 130 are excited to generate the first frequency band FB1. The first radiation element 110 and the second radiation element 120 are excited to generate the second frequency band FB2. The first radiation element 110 is excited to generate the third frequency band FB3. According to the practical measurement, the frequency range of the third frequency band FB3 can be fine-tuned by changing the sizes and the positions of the first opening 140 and the second opening 150 because of the coupling effect between the radiation elements.

In some embodiments, the element sizes of the antenna structure 100 are as follows. The total length L1 of the first radiation element 110, the second radiation element 120, and the third radiation element 130 (i.e., the total length L1 from the first end 111 through the first end 121 and the second end 122 to the second end 132) may be substantially equal to 0.25 wavelength (λ/4) of the first frequency band FB1. The total length L2 of the first radiation element 110 and the second radiation element 120 (i.e., the total length L2 from the first end 111 through the first end 121 to the second end 122) may be substantially equal to 0.25 wavelength (λ/4) of the second frequency band FB2. The length L3 of the first radiation element 110 (i.e., the length L3 from the first end 111 to the second end 112) may be substantially equal to 0.25 wavelength (λ/4) of the third frequency band FB3. The above wavelengths means the wavelengths of the antenna structure 100 operating in free space. If the antenna structure 100 is disposed on a plastic fixing (supporting) element or a dielectric substrate, the aforementioned total length L1 may be from 0.15 to 0.17 wavelength (0.15λ~0.17λ) of the first frequency band FB1, the aforementioned total length L2 may be from 0.15 to 0.17 wavelength (0.15λ~0.17λ) of the second frequency band FB2, and the aforementioned length L3 may be from 0.15 to 0.17 wavelength (0.15λ~0.17λ) of the third frequency band FB3. The width W1 of the first radiation element 110 may be greater than the width W3 of the third radiation element 130. The width W3 of the third radiation element 130 may be greater than the width W2 of the second radiation element 120 (i.e., W1>W3>W2). The first angle θ1 may be substantially equal to 45 degrees. The second angle θ2 may also be substantially equal to 45 degrees. There is a first distance D1 between the feeding point FP and the first end 111 of the first radiation element 110. The first distance D1 may be from 1 mm to 2 mm. There is a second distance D2 between the first opening 140 and the second opening 150. The second distance D2 may be from 5 mm to 10 mm, such as 8.5 mm. There is a third distance D3 between the first opening 140 and the first end 131 of the third radiation element 130. The third distance D3 may be from 1 mm to 2 mm, such as 1.2 mm. There is a fourth distance D4 between the second opening 150 and the second end 132 of the third radiation element 130. The fourth distance D4 may be from 1 mm to 5 mm, such as 2.3 mm. The second distance D2 may be longer than the third distance D3, and may also be longer than the fourth distance D4. The fourth distance D4 may be longer than or equal to the third distance D3. For example, the second distance D2 may be 5 to 10 times the third distance D3, such as 7 times the third distance D3; the second distance D2 may be 2 to 5 times the fourth distance D4, such as 3.7 times the fourth distance D4. The radius R1 of the first opening 140 may be from 0.2 mm to 0.8 mm, such as 0.5 mm. The radius R2 of the second opening 150 may be from 0.2 mm to 0.8 mm, such as 0.5 mm. The radius R1 of the first opening 140 may be substantially equal to the radius R2 of the second opening 150. The above ranges of element sizes are calculated and obtained according to many experiment results, and they help to optimize the operation bandwidth and impedance matching of the antenna structure 100.

Figure 3:
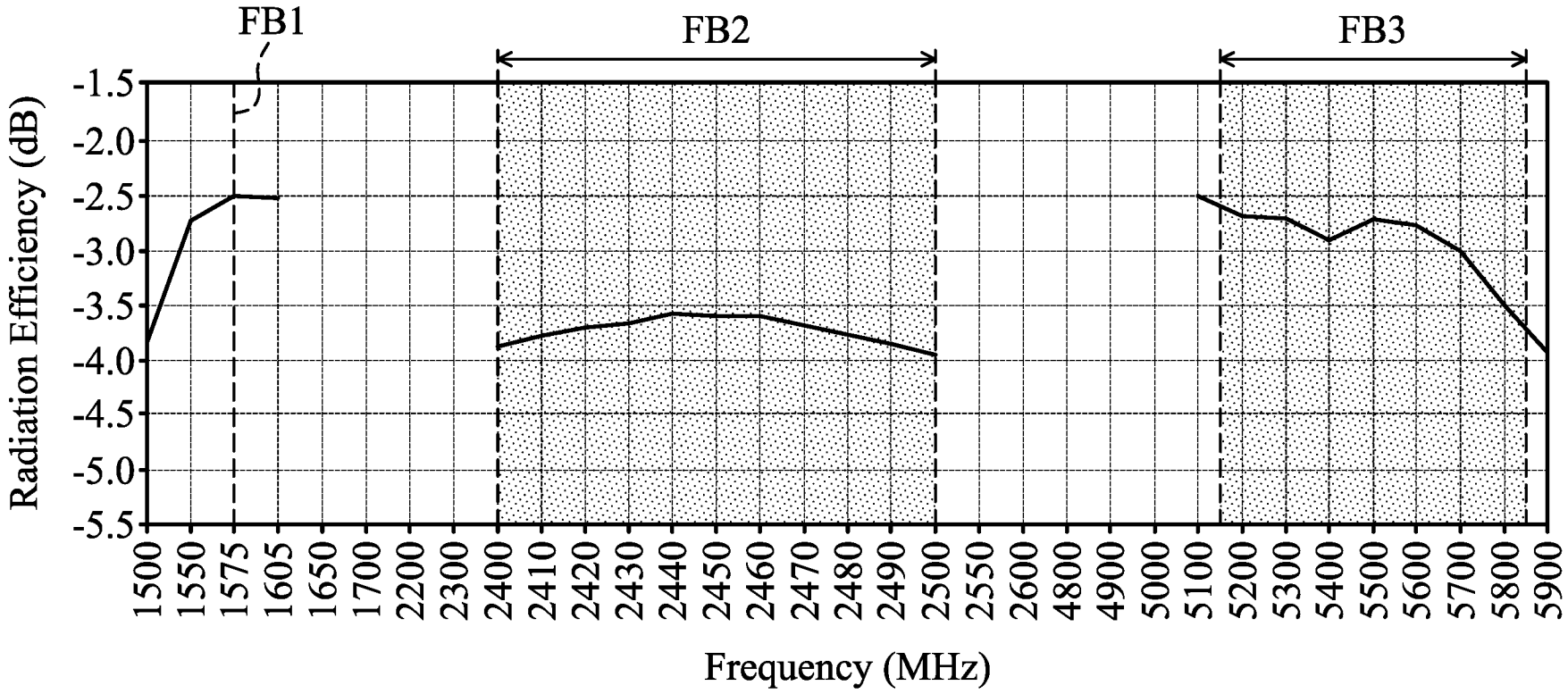
FIG. 3 is a diagram of radiation efficiency of an antenna structure according to an embodiment of the invention.

FIG. 3 is a diagram of radiation efficiency of the antenna structure 100 according to an embodiment of the invention. The horizontal axis represents the operation frequency (MHz), and the vertical axis represents the radiation efficiency (dB). According to the measurement of FIG. 3, the radiation efficiency of the antenna structure 100 may be about −2.5 dB within the first frequency band FB1, the radiation efficiency of the antenna structure 100 may be about −3.58 dB within the second frequency band FB2, and the radiation efficiency of the antenna structure 100 may be about −2.68 dB within the third frequency band FB3. It can meet the requirements of practical application of general mobile communication devices.

The invention proposes a novel antenna structure. In comparison to the conventional antenna design, it has at least the advantages of: (1) being almost a planar design; (2) being easy for mass production and manufacturing; (3) covering GPS and WLAN frequency bands; (4) minimizing the overall size; (5) having a low manufacturing cost. Therefore, the antenna structure of the invention is suitable for application in a variety of current small-size mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-3. The invention may include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a first radiation element, having a feeding point;

a second radiation element; and a third radiation element, coupled through the second radiation element to the first radiation element, wherein the third radiation element has a first opening and a second opening which are separate from each other;

wherein the antenna structure covers a first frequency band, a second frequency band, and a third frequency band;

wherein the first radiation element, the second radiation element, and the third radiation element form a planar structure;

wherein a first angle is formed between the first radiation element and the second radiation element, and the first angle is smaller than 90 degrees;

wherein a distance between the first opening and the second opening is from 5 mm to 10 mm;

wherein incorporation of the first opening and the second opening can fine-tune impedance matching of the antenna structure, thereby increasing a whole operation bandwidth of the antenna structure.

2. The antenna structure as claimed in claim 1, wherein the first frequency band is substantially 1575 MHz, the second frequency band is from 2400 MHz to 2500 MHz, and the third frequency band is from 5150 MHz to 5850 MHz.

3. The antenna structure as claimed in claim 1, wherein the first radiation element substantially has a rectangular shape.

4. The antenna structure as claimed in claim 1, wherein the second radiation element substantially has a trapezoidal shape.

5. The antenna structure as claimed in claim 1, wherein the third radiation element substantially has a straight-line shape.

6. The antenna structure as claimed in claim 1, wherein the first radiation element and the third radiation element are substantially parallel to each other.

7. The antenna structure as claimed in claim 1, wherein the first angle is substantially equal to 45 degrees.

8. The antenna structure as claimed in claim 1, wherein a second angle is formed between the third radiation element and the second radiation element, and the second angle is from 0 to 90 degrees.

9. The antenna structure as claimed in claim 8, wherein the second angle is substantially equal to 45 degrees.

10. The antenna structure as claimed in claim 8, wherein a sum of the first angle and the second angle is substantially equal to 90 degrees.

11. The antenna structure as claimed in claim 1, wherein each of the first opening and the second opening substantially has a circular shape.

12. The antenna structure as claimed in claim 1, wherein the first radiation element, the second radiation element, and the third radiation element are excited to generate the first frequency band.

13. The antenna structure as claimed in claim 1, wherein a total length of the first radiation element, the second radiation element, and the third radiation element is substantially equal to 0.25 wavelength of the first frequency band.

14. The antenna structure as claimed in claim 1, wherein the first radiation element and the second radiation element are excited to generate the second frequency band.

15. The antenna structure as claimed in claim 1, wherein a total length of the first radiation element and the second radiation element is substantially equal to 0.25 wavelength of the second frequency band.

16. The antenna structure as claimed in claim 1, wherein the first radiation element is excited to generate the third frequency band.

17. The antenna structure as claimed in claim 1, wherein a length of the first radiation element is substantially equal to 0.25 wavelength of the third frequency band.

18. The antenna structure as claimed in claim 1, wherein a width of the first radiation element is greater than a width of the third radiation element.

19. The antenna structure as claimed in claim 1, wherein a width of the third radiation element is greater than a width of the second radiation element.

* * * * *